US007344388B2

(12) United States Patent
Kreuter

(10) Patent No.: US 7,344,388 B2
(45) Date of Patent: Mar. 18, 2008

(54) PRESS-IN CONTACT WITH CRIMP ARMS FOR A CIRCUIT BOARD

(75) Inventor: Markus Kreuter, Hohenems (AT)

(73) Assignee: Hirschmann Automotive GmbH, Rankweil/Brederis (AT)

( * ) Notice: Subject to any disclaimer, the term of this patent is extended or adjusted under 35 U.S.C. 154(b) by 0 days.

(21) Appl. No.: 11/603,270

(22) Filed: Nov. 21, 2006

(65) Prior Publication Data

US 2007/0123083 A1 May 31, 2007

(30) Foreign Application Priority Data

Nov. 24, 2005 (DE) ..... 10 2005 056 386

(51) Int. Cl.
*H01R 12/00* (2006.01)

(52) U.S. Cl. ..... 439/82; 439/751; 439/877; 439/442; 439/430

(58) Field of Classification Search ..... 439/82, 439/741, 877, 442, 430, 751–752
See application file for complete search history.

(56) References Cited

U.S. PATENT DOCUMENTS 3,514,746 A * 5/1970 Kinkaid et al. ..... 439/877
4,533,204 A * 8/1985 Moynagh et al. ..... 439/751
5,374,204 A * 12/1994 Foley et al. ..... 439/751
5,718,606 A * 2/1998 Rigby et al. ..... 439/608
6,478,633 B1 * 11/2002 Hwang ..... 439/754

* cited by examiner

*Primary Examiner*—Truc Nguyen
(74) *Attorney, Agent, or Firm*—Andrew Wilford

(57) ABSTRACT

The invention relates to a device for contacting an electrical conductor of a cable with a conductor trace (8) of a circuit board (2), characterized in that the device is made as a press-in contact (1) fittable in a hole of the circuit board (2) and securable there without solder and having a press-in part electrically contacting the conductor trace (8) and a contacting region (5) for securing and electrically contacting the end of the electrical conductor of the cable.

6 Claims, 1 Drawing Sheet

PRESS-IN CONTACT WITH CRIMP ARMS FOR A CIRCUIT BOARD

FIELD OF THE INVENTION

The invention relates to a press-in contact having a crimp arm for a printed-circuit board and serving to connect an electrical conductor of a cable with a conductor trace of the circuit board.

BACKGROUND OF THE INVENTION

It is known that a cable end, the electrical conductor of which is to be electrically contacted to a conductor trace of a printed-circuit board, is prepared and contacted in the following manner: The cable, which has either only a single electrical conductor or multiple electrical conductors, is freed of its insulation (stripped) in the end region and is fitted into a throughgoing hole in the printed-circuit board and then soldered there to the conductor trace which surrounds the hole. Thus, although an electrically reliable and mechanically stable connection is established between the cable and the printed-circuit board, this is not always advantageous, since not all types of cable (circular conductors, stranded conductors, ribbon cable, and the like) may be readily used. Furthermore, a soldered connection is problematic when the surrounding temperatures cause softening under heat and even complete melting of the solder.

OBJECT OF THE INVENTION

The object of the invention, therefore, is to provide a universal contact that can be economically manufactured and by means of which a conductor trace of a printed-circuit board may be quickly and easily connected in an electrically and mechanically reliable manner to the electrical conductor. In particular, the aim is to avoid problems at especially high surrounding temperatures.

SUMMARY OF THE INVENTION

This object is achieved. according to the invention, in that the device for contacting an electrical conductor of a cable to a conductor trace of a printed-circuit board is designed as a press-in contact having a press-in part which may be inserted into a hole in the printed-circuit board and electrically connected to the conductor trace, and having a contacting region for securing and electrically contacting the end of the electrical conductor of the cable. The invention thus provides a press-in contact which may be easily manufactured in a stamping/bending process. The stamping/bending process has the advantage that in an automated process the press-in contact is shaped so that it may automatically be further processed (installed) and also provides the necessary electrical and mechanical contact security. To this end, the press-in contact has a press-in part by means of which it is inserted through a hole in the printed-circuit board and is secured in a force-fit and/or form-fit manner. The appropriate shaping of the press-in part ensures that on the one hand the electrical contacting with the conductor trace is reliably and durably established, and on the other hand the press-in contact is mechanically fixed in place on the printed-circuit board, so that the electrical conductor may be mounted at its contacting region facing away from the press-in part. The contacting region for the electrical conductor is designed in such a way that the prepared end of the electrical conductor may be attached at that location to an electrically conductive material or the like by soldering, welding, crimping, or gluing. The embodiment of the contacting region as a crimping region is particularly preferred, since a crimped connection produces a gas-tight and thus durable connection, and various types of electrical conductors (circular conductors or ribbon conductors of various cross-sectional diameters) may be secured to the press-in contact.

In other words, the press-in part and/or the contacting region may be designed in such a way that the press-in contact may be easily, quickly, and durably secured in a reliable manner by means of a force-fit and/or form-fit and/or material-fit connection to the conductor trace of the conductor trace or to the electrical conductor. Pressing the press-in contact into the hole in the printed-circuit board, thereby electrically contacting the conductor trace and press-in contact to one another and fixing the press-in contact in position on the printed-circuit board and thus fastening it, also has the advantage that surrounding temperatures may exist which otherwise would melt a soldered connection. At such surrounding temperatures it is also of significant advantage when the connection between the press-in contact and the electrical conductor is likewise resistant to high temperature, such as a crimped connection, for example.

BRIEF DESCRIPTION OF THE DRAWING

One illustrated embodiment, to which the invention is not restricted, is illustrated in FIGS. 1 and 2 and described below.

SPECIFIC DESCRIPTION

Figure 1:
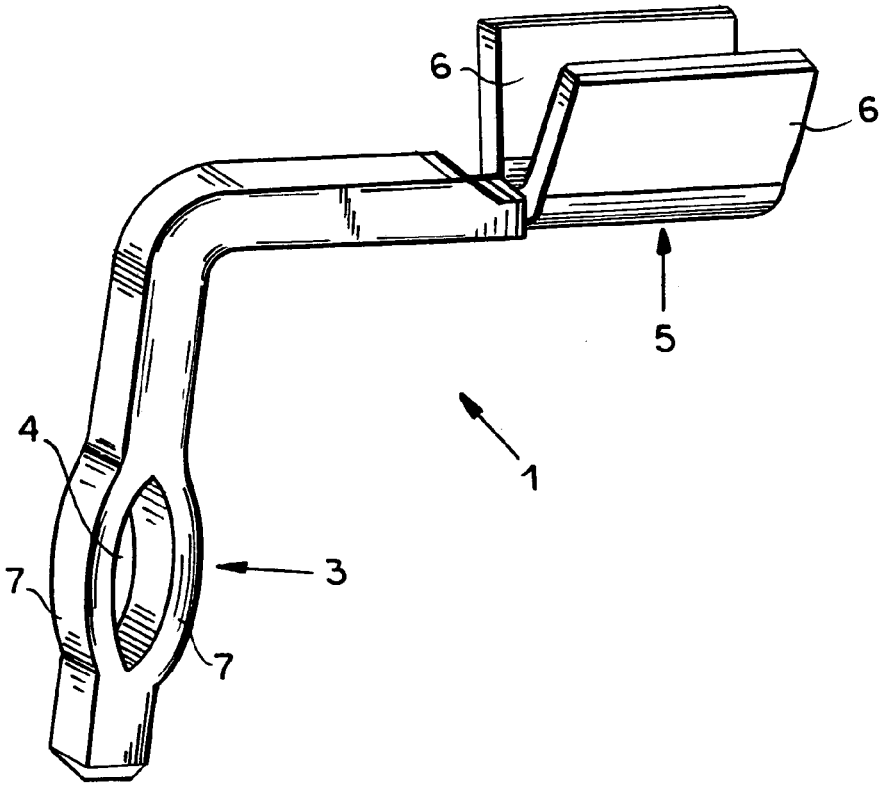
Figure 2:
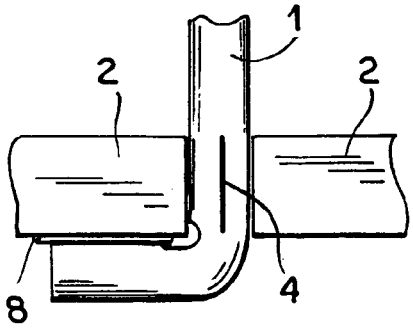

FIGS. 1 and 2 show in detailed illustrations a press-in contact 1 in a bent variant (other, in particular linear, variants also being possible). In other words, the contacting region projects vertically from the surface of the printed-circuit board, or is approximately perpendicular to the surface of the printed-circuit board. The press-in contact 1 together with its press-in part 3 is pushed through a corresponding hole in a printed-circuit board 2 and is secured there. In this illustrated embodiment the press-in part 3 is provided with a slot 4, so that the branches flanking the slot 4 are bent slightly outward and extend out such that the spread is slightly larger than the diameter of the hole in the printed-circuit board 2. By appropriate processing of this press-in part 3 the press-in contact 1 is thus electrically contacted with the conductor trace, not illustrated here, (above or below) the printed-circuit board 2, and is mechanically fixed in position and thereby fastened to the printed-circuit board 2.

On the side of the press-in contact 1 facing away from the press-in part 3 a contacting region 5 is present, to which an electrical conductor, not illustrated here (for example, a circular conductor, stranded conductor, ribbon cable, or the like) is electrically and mechanically secured after stripping (i.e., removal of the outer sheathing). In addition to contacting methods such as soldering, welding, electrical adhesive bonding, or the like, crimping in particular may be considered, for which purpose the contacting region 5 has an approximately U-shaped cross section having two arms 6 before insertion of the electrical conductor. After the electrical conductor has been inserted into the contacting region 5, the crimping process is carried out by use of a suitable crimping tool, by which the two arms 6 are bent inward and thereby contact the electrical conductor in a gas-tight manner. It is particularly advantageous for the contacting region 5, in particular the crimping region, to be matched to the geometry of the electrical conductor in order to achieve the optimum connection results.

FIG. 1 also shows that the press-in contact 1, at least in the region between the slot 4 and the contacting region 5, has a rectangular, preferably square, cross-sectional shape.

An examination of FIG. 2 clearly shows that the slot 4 and the branches 7 of the press-in contact 1 which form the slot 4 are dimensioned such that, after the press-in contact 1 is pressed into the hole in the printed-circuit board 2, the branches 7 under pretensioning come to bear against inner surfaces of the hole in the printed-circuit board (FIG. 2, left illustration). This position results in an electrical connection between the press-in contact 1 and the conductor trace, not illustrated; the conductive regions are partially situated around the hole in the printed-circuit board, or extend into the hole, optionally extending to the opposite side of the printed-circuit board (through-contacting). The spreading effect of the two branches 7 (optionally, more than two branches are also possible) causes the press-in contact 1 to be fastened and fixed mechanically in place on the printed-circuit board 2. In particular, the slot 4 closes completely after the press-in contact 1 is completely pressed into the hole in the printed-circuit board 2; i.e. the press-in part 3 is fully compressed (FIG. 2, right illustration). However, the diameter of the press-in contact is still at least slightly larger than the inner diameter of the hole in the printed-circuit board 2. It is also possible to bend the downwardly projecting end region of the press-in contact 1 around and below the press-in part 3 for placing this end against or on the conductor trace 8 and thus achieving improved contacting (see FIG. 2, right illustration).

The press-in contact 1 shown in the figures has the particular advantage that it may be quickly and economically manufactured in a stamping and bending process.

The invention therefore preferably (but not in a limiting manner) involves a strict crimp/press-in contact. This affords the possibility of, for example, contacting stranded cable on rigid or flexible printed-circuit boards (FPCB's) with conductor traces located thereon. This is primarily of advantage when the module (for example, an electronic device having a printed-circuit board in a housing) is exposed to temperatures that exceed the operating range of soldered connections. The press-in part and the crimped region may be implemented in different variants, in particular with respect to size, cable cross section, press-in zone, insulation crimp, etc. It would also be possible to provide a soldered or welded region instead of a crimped region.

The invention claimed is:

1. In combination with a circuit board formed with a throughgoing hole of predetermined diameter and having a face provided with a conductive trace immediately adjacent the hole and with an electrical cable having a conductor, a contact device comprising:

an elongated contact having a press-in part formed with a transversely throughgoing slot and with a contacting region offset from the press-in part, the slot forming a pair of branches, the press-in part being force-fitted in the hole such that the branches are pressed together to completely close the slot, the cable conductor being connected to the contacting region offset from the press-in part, the press-in part having an end region projecting past the hole and bent back and bearing on the conductive trace adjacent the hole.

2. The device according to claim 1 wherein the contacting region has wings forming a crimp connection for the electrical conductor.

3. The device according to claim 1 wherein the contacting region extends perpendicular from a face of the circuit board.

4. The device according to claim 1 wherein the contacting region extends generally perpendicular to a face of the circuit board.

5. The device according to claim 1 wherein the press-in contact at least in a region between the slot and the contacting region is of rectangular cross-sectional shape.

6. The device according to claim 1 wherein the press-in contact is made in a stamping/bending process.

* * * * *